US007582191B2

(12) United States Patent
Suzuki et al.

(10) Patent No.: US 7,582,191 B2
(45) Date of Patent: Sep. 1, 2009

(54) PROCESS FOR PRODUCING LOUDSPEAKER DIAPHRAGM, LOUDSPEAKER DIAPHRAGM PRODUCED BY THE PROCESS, AND LOUDSPEAKER WITH THE DIAPHRAGM

(75) Inventors: Takashi Suzuki, Mie (JP); Shinya Mizone, Mie (JP)

(73) Assignee: Panasonic Corporation, Osaka (JP)

( * ) Notice: Subject to any disclaimer, the term of this patent is extended or adjusted under 35 U.S.C. 154(b) by 138 days.

(21) Appl. No.: 11/814,404

(22) PCT Filed: Jan. 23, 2006

(86) PCT No.: PCT/JP2006/300935

§ 371 (c)(1),
(2), (4) Date: Jul. 20, 2007

(87) PCT Pub. No.: WO2006/100822

PCT Pub. Date: Sep. 28, 2006

(65) Prior Publication Data

US 2008/0156576 A1 Jul. 3, 2008

(30) Foreign Application Priority Data

Mar. 22, 2005 (JP) ..... 2005-080943

(51) Int. Cl.
*D21F 13/00* (2006.01)

(52) U.S. Cl. ..... 162/218; 162/228; 162/226; 162/382; 162/387; 181/169; 181/167

(58) Field of Classification Search ..... 162/218, 162/228, 226, 382, 387; 181/169, 167
See application file for complete search history.

(56) References Cited

U.S. PATENT DOCUMENTS 7,118,649 B2 * 10/2006 Morohoshi et al. ..... 162/228
2004/0079505 A1 * 4/2004 Morohoshi et al. ..... 162/218

FOREIGN PATENT DOCUMENTS

| | | |
|---|---|---|
| JP | 29-000503 | 5/1952 |
| JP | 52-007234 | 1/1977 |
| JP | 55-124396 | 9/1980 |
| JP | 57-180799 | 11/1982 |
| JP | 62-041100 | 3/1987 |
| JP | 04-189099 | 7/1992 |
| JP | 2003-230197 | 8/2003 |

OTHER PUBLICATIONS

International Search Report for application No. PCT/JP2006/300935 dated Apr. 25, 2006.

* cited by examiner

*Primary Examiner*—Mark Halpern
(74) *Attorney, Agent, or Firm*—RatnerPrestia

(57) ABSTRACT

In a process for producing a loudspeaker diaphragm, pulp is deposited on a paper-making mold in the presence of vortex stream of water having pulp dispersed therein in a paper-making bath. Pulp is deposited on the paper-making mold while at least the water having pulp dispersed therein is rotated by the vortex stream in the paper-making bath. Consequently, variation of pulp fiber orientation is suppressed, and a loudspeaker diaphragm with high reproducibility and stable quality is produced with a high productivity.

10 Claims, 4 Drawing Sheets

FIG. 5 - PRIOR ART
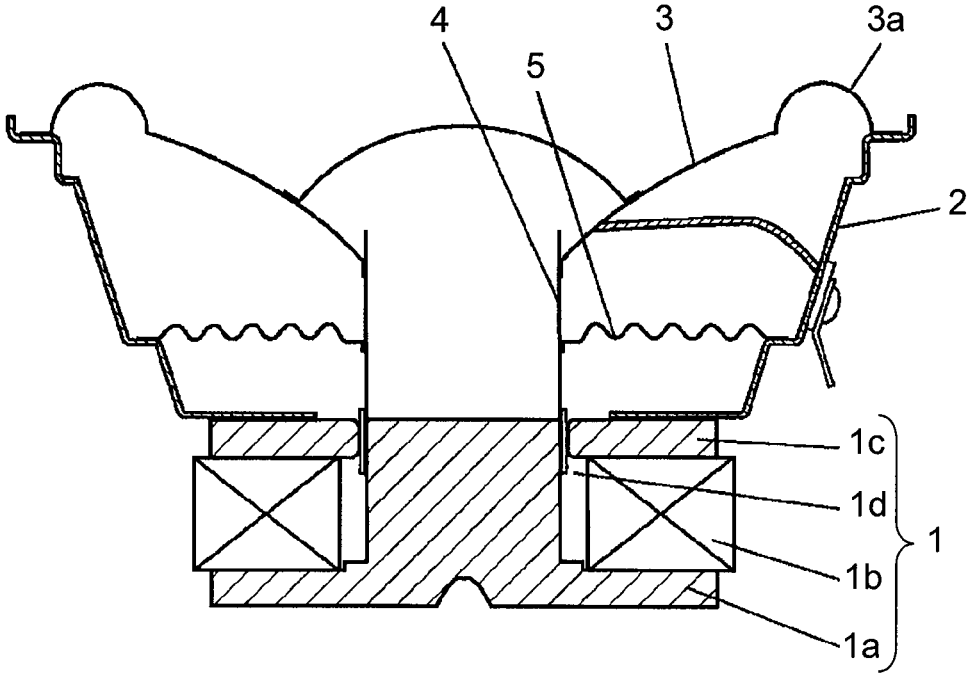
FIG. 6 - PRIOR ART
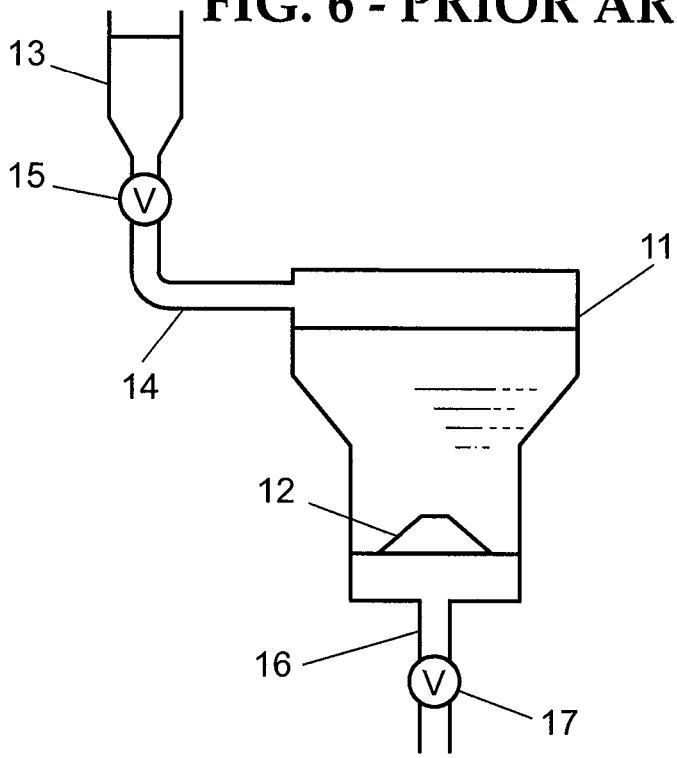

PROCESS FOR PRODUCING LOUDSPEAKER DIAPHRAGM, LOUDSPEAKER DIAPHRAGM PRODUCED BY THE PROCESS, AND LOUDSPEAKER WITH THE DIAPHRAGM

This application is a 371 of PCT/JP2006/300935 filed on 23 Jan. 2006

TECHNICAL FIELD

The present invention relates to a process for producing a loudspeaker diaphragm used for various audio apparatuses, a loudspeaker diaphragm produced by the process, and a loudspeaker with the diaphragm.

BACKGROUND ART

A conventional technology will be described with reference to FIG. 5 and FIG. 6.

FIG. 5 is a side sectional view of a conventional loudspeaker, and FIG. 6 is a schematic block diagram of a paper-making device of a loudspeaker diaphragm as an essential part of the loudspeaker.

The conventional loudspeaker has magnetic circuit 1, frame 2, conical loudspeaker diaphragm 3, voice coil 4, and damper 5. Magnetic circuit 1 is formed by bonding lower plate 1*a* having a center pole, annular magnet 1*b*, and upper plate 1*c* superimposed on magnet 1*b*. Magnetic gap 1*d* is formed between the outer periphery of the center pole and the inner periphery of upper plate 1*c*. Frame 2 is bonded to upper plate 1*c*. The outer periphery of loudspeaker diaphragm 3 is bonded to frame 2 via edge 3*a*, and the lower part of the inner periphery thereof is bonded to voice coil 4 engaged with magnetic gap 1*d*. Damper 5 for supporting voice coil 4 vertically movably is bonded to voice coil 4 on its inner periphery, and is bonded to frame 2 on its outer periphery.

In the loudspeaker having the above-mentioned configuration, a voice signal is input as an external signal into voice coil 4, thereby moving loudspeaker diaphragm 3 vertically to produce a sound.

The loudspeaker diaphragm is made of paper, resin, or metal foil. Paper having undergone paper-making is generally used as the loudspeaker diaphragm in consideration of the following parameters:

- physical properties such as magnitudes of internal loss and rigidity that are essentially required of a loudspeaker diaphragm;
- cost; and
- good sound making ability with a blend of various wood pulp as materials thereof.

FIG. 6 shows a producing process of loudspeaker diaphragm 3 formed by the paper-making. The paper-making device shown in FIG. 6 has the following elements: (1) paper-making bath 11 for supplying water having beaten pulp dispersed therein to an after-mentioned paper-making mold, (2) paper-making mold 12 formed of a wire mesh or the like, (3) measuring bath 13 for water having pulp dispersed therein, (4) supply pipe 14, (5) valve 15 for opening and closing a flow channel, (6) drainage pipe 16, and (7) valve 17 for opening and closing a drainage channel.

In a paper-making process using the paper-making device, water where pulp controlled in concentration is dispersed is firstly measured in measuring bath 13, and flow channel opening/closing valve 15 is then opened or closed to supply the pulp to paper-making bath 11 through supply pipe 14.

Thus, the pulp dispersed in a certain amount of water is supplied into paper-making bath 11, and gradually starts to be deposited onto paper-making mold 12 of paper-making bath 11. For performing this process in a short time, generally, the water is rapidly discharged from drainage pipe 16. This process is called as "suki-otoshi" paper-making method. At this time, random vortex occurs near the drainage port in the paper-making bath, and the pulp is deposited on paper-making mold 12 in random stream that can be caused by the random vortex in paper-making bath 11. The deposit is extracted and dried, a center hole is punched, and the outer periphery is removed, thereby providing a loudspeaker diaphragm.

There is another paper-making process in which water having a large amount of pulp dispersed therein is supplied into the paper-making bath, a wire cloth is put into the water having pulp dispersed therein in the paper-making bath, and the wire cloth is raised from the water. This process is called as "suki-age" paper-making method.

The conventional loudspeaker diaphragm and its producing process are disclosed in Japanese Patent Unexamined Publication No. 2003-230197, for example.

The loudspeaker diaphragm employing pulp is inexpensive, allows blending of various pulps, and easily provides a desired acoustic characteristic. However, there are the following difficulties in managing the loudspeaker diaphragm. Random stream in the paper-making bath in the paper-making process causes variation of deposition on pulp paper-making mold 12 and variation of pulp fiber orientation, or large variation of face thickness and face rigidity occurs even on the same circumference in the same diaphragm. As the performance of digital acoustic apparatuses has been recently increased by their development, higher reproducibility has been required of loudspeaker diaphragms.

SUMMARY OF THE INVENTION

The present invention provides a process for producing a loudspeaker diaphragm that has a step of depositing pulp on a paper-making mold in the presence of vortex stream of water having pulp dispersed therein in a paper-making bath. The pulp is deposited on the paper-making mold while the water having pulp dispersed therein is rotated by vortex stream in the paper-making bath. Consequently, variation of pulp fiber orientation can be suppressed, and a loudspeaker diaphragm with high reproducibility and stable quality can be produced with a high productivity.

A loudspeaker diaphragm of the present invention is produced using the above-mentioned process for producing the loudspeaker diaphragm. A loudspeaker diaphragm having stable face thickness and face rigidity and high reproducibility can be produced with a high productivity.

A loudspeaker of the present invention employs the loudspeaker diaphragm, and a loudspeaker having small variation of acoustic characteristic and high reproducibility can be produced.

BRIEF DESCRIPTION OF DRAWINGS

FIG. 5 is a side sectional view of a conventional loudspeaker.

FIG. 6 is a schematic block diagram of a paper-making bath as an essential part of a producing process of a conventional loudspeaker diaphragm.

REFERENCE MARKS IN THE DRAWINGS

Figure 1:
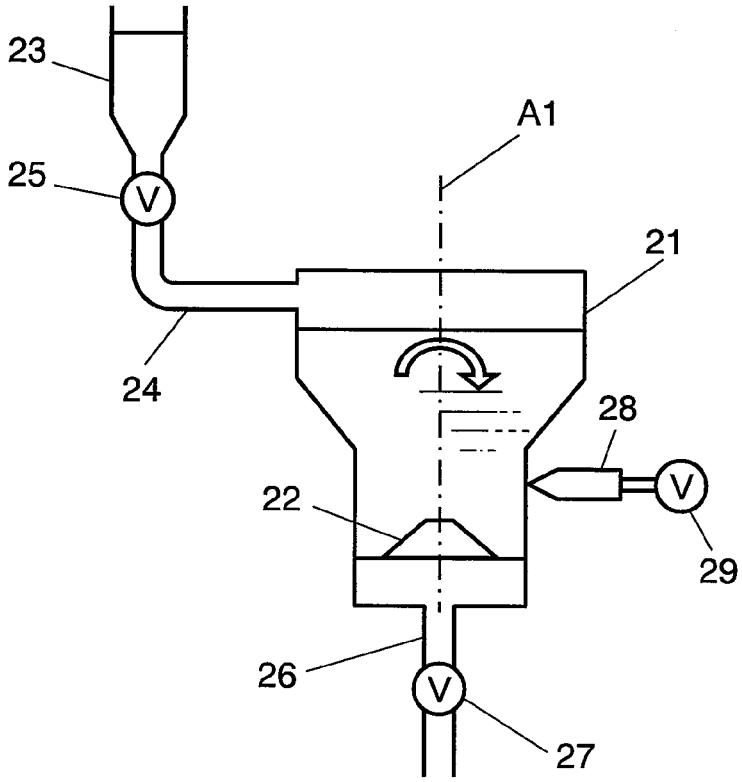
FIG. 1 is a schematic block diagram of a paper-making bath in a producing process of a loudspeaker diaphragm in accordance with an exemplary embodiment of the present invention.

1 magnetic circuit
1*a* lower plate
1*b* magnet
1*c* upper plate
1*d* magnetic gap
2 frame
3 loudspeaker diaphragm
3*a* edge
4 voice coil
5 damper
11 paper-making bath
12 paper-making mold
13 measuring bath
14 supply pipe
15 opening/closing valve
16 drainage pipe
17 opening/closing valve
21 paper-making bath
22 paper-making mold
23 measuring bath
24 supply pipe
25 opening/closing valve
26 drainage pipe
27 opening/closing valve
28 pressurized water nozzle
29 opening/closing valve
30*a*, 30*b* rotation plates
30*c* attaching shaft

DETAILED DESCRIPTION OF PREFERRED EMBODIMENTS

In a producing process of a loudspeaker diaphragm of the present invention, water having beaten pulp dispersed therein is deposited on a paper-making mold in a paper-making bath while vortex stream is generated forcibly, thereby producing the loudspeaker diaphragm. Pulp is deposited on the paper-making mold while at least the whole water having the pulp dispersed therein in the paper-making bath is uniformly rotated by vortex stream, so that the variation of pulp fiber orientation can be suppressed. Thus, a loudspeaker diaphragm with high reproducibility and stable quality can be produced with a high productivity.

In a producing process of a loudspeaker diaphragm of the present invention, pressurized water may be sprayed to water having pulp dispersed therein, and vortex stream may be generated forcibly. The spray of the pressurized water allows extremely easy generation of vortex stream with which pulp fiber is oriented in a constant direction. Thus, a loudspeaker diaphragm having stable face thickness and face rigidity on the same circumference in the same diaphragm can be produced. A plurality of kinds of pressurized water may be sprayed to water having pulp dispersed therein to generate vortex stream. The spray of the plurality of kinds of pressurized water allows enlargement of the paper-making bath, further facilitates the generation and control of the vortex stream, and can improve productivity.

In a producing process of a loudspeaker diaphragm of the present invention, pressurized air may be sprayed to generate vortex stream. Since the vortex stream is generated by spray of the pressurized air, the vortex stream can be generated without varying the state of the water having pulp dispersed therein in the paper-making bath and the reproducibility in paper-making can be improved, comparing with the case of spraying the pressurized water.

In a producing process of a loudspeaker diaphragm of the present invention, a rotation plate may be lowered into the paper-making bath, and the rotation plate may be rotated to generate vortex stream. The rotation of the rotation plate easily generates vortex stream, and easily orients the pulp fiber in a specific direction.

In a producing process of a loudspeaker diaphragm of the present invention, a rotation plate previously installed in the paper-making bath may be rotated to generate vortex stream. The installation of the rotation plate in the paper-making bath allows downsizing of the paper-making bath. Providing a plurality of rotation plates facilitates the generation of vortex stream and control of vortex.

A loudspeaker diaphragm using a producing process of a loudspeaker diaphragm of the present invention has stable face thickness and stable face rigidity. Therefore, a loudspeaker diaphragm with high reproducibility can be provided with a high productivity.

A loudspeaker employing the loudspeaker diaphragm of the present invention has small variation of acoustic characteristic and high reproducibility.

In a producing process of a loudspeaker diaphragm of the present invention, by forcibly generating vortex stream in water having pulp dispersed therein in the paper-making bath, pulp can be deposited on the paper-making mold while a constant amount of stable vortex stream is kept in the water having pulp dispersed therein. The above producing process can provide a loudspeaker diaphragm in which uniformity of the pulp fiber orientation, no variation of face thickness and face rigidity on the same circumference in the same diaphragm, high reproducibility, and stable quality are attained.

Exemplary embodiments of the present invention will be hereinafter described further specifically.

First Exemplary Embodiment

A production unit of a loudspeaker diaphragm used in the first exemplary embodiment is described with reference to FIG. 1.

The production unit of the first exemplary embodiment has the following elements: (1) paper-making bath 21 for supplying water having beaten pulp dispersed therein to paper-making mold 22, (2) paper-making mold 22 formed of a wire mesh or the like, (3) measuring bath 23 for water having pulp dispersed therein, (4) supply pipe 24, (5) valve 25 for opening and closing a flow channel, (6) drainage pipe 26, (7) valve 27 for opening and closing a drainage channel, (8) pressurized water nozzle 28 for generating vortex stream in the paper-making bath, and (9) valve 29 for opening and closing a flow channel of pressurized water.

Pressurized water opening/closing valve 29 is opened, thereby spraying pressurized water from the tip of pressurized water nozzle 28 to water having pulp dispersed therein in paper-making bath 21 for a certain time. By spraying the pressurized water, the water having pulp dispersed therein in paper-making bath 21 generates vortex stream as shown by the arrow of FIG. 1, for example. Also after closing pressurized water opening/closing valve 29, the water having pulp dispersed therein can keep a certain vortex stream due to the inertia for a certain time. Drainage channel opening/closing valve 27 is opened within a time when the vortex stream is kept, and the drainage from paper-making bath 21 through drainage pipe 26 is started.

The spray direction of the pressurized water is simply required to be a direction in which the water in paper-making bath 21 rotates about center axis A1. Therefore, the spray is preferably performed in a direction shifted from the direction heading for center axis A1 of paper-making bath 21. More preferably, the spray is performed in a direction substantially orthogonal to center axis A1 (that is, tangential direction to a circle around center axis A1). Preferably, the shape of the inner periphery of paper-making bath 21 does not disturb swirling and rotation of water, and the inner peripheral shape of a cylinder is appropriate, for example. Center axis A1 preferably matches with center axis A1 of paper-making mold 22.

In the above steps, the water having pulp dispersed therein is discharged from paper-making bath 21 while the certain vortex stream is kept in paper-making bath 21. As a result, a loudspeaker diaphragm is produced where pulp fiber is oriented in the constant direction on paper-making mold 22 in paper-making bath 21. The obtained loudspeaker diaphragm has pulp fiber that is oriented substantially axisymmetrically with respect to center axis A1. The loudspeaker diaphragm produced in this manner has stable face thickness and stable face rigidity on the same circumference in the same diaphragm.

An example where one pressurized water nozzle 28 is installed is described in the first exemplary embodiment; however, a plurality of pressurized water nozzles 28 may be installed. Installing the plurality of pressurized water nozzles 28 in paper-making bath 21 can generate stabler vortex stream in the water having pulp dispersed therein in a short time, and allows efficient production of a loudspeaker diaphragm with stabler physical properties. In this case, pressurized water nozzles 28 are arranged so that pressurized waters sprayed from pressurized water nozzles 28 do not cancel each other. Therefore, though all of pressurized water nozzles 28 are not required to be installed at the same angle, preferably, all of pressurized water nozzles 28 point to a desired rotation direction of the water.

A pressurized air nozzle may be disposed instead of pressurized water nozzle 28 of the first exemplary embodiment, and may generate vortex stream with the pressurized air. Additionally, a plurality of pressurized air nozzles are disposed, thereby generating stable vortex stream in a short time similarly to the case employing pressurized water, simplifying the facility structure, and building the facility inexpensively.

Second Exemplary Embodiment

Figure 2:
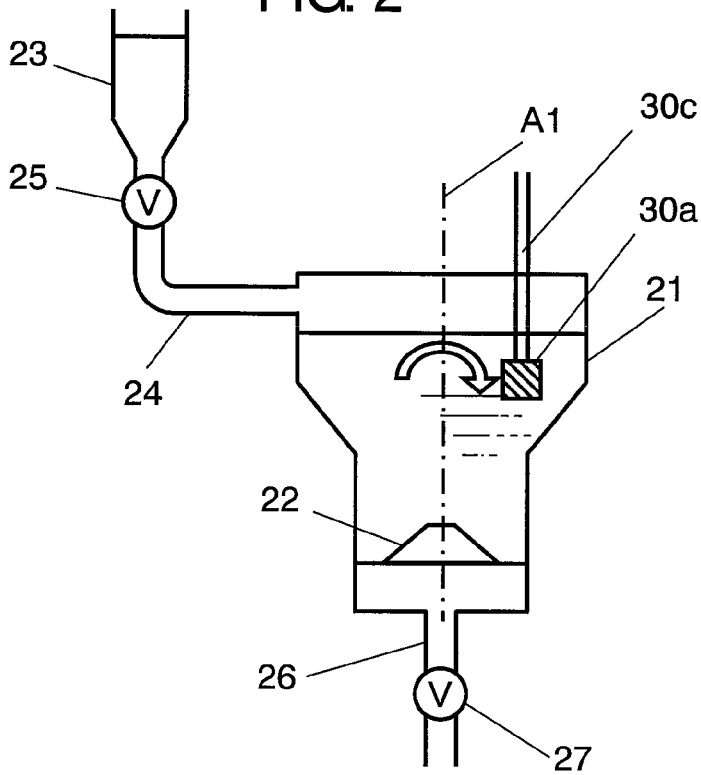
FIG. 2 is a schematic block diagram of a paper-making bath in a producing process of a loudspeaker diaphragm in accordance with another exemplary embodiment of the present invention.
Figure 3:
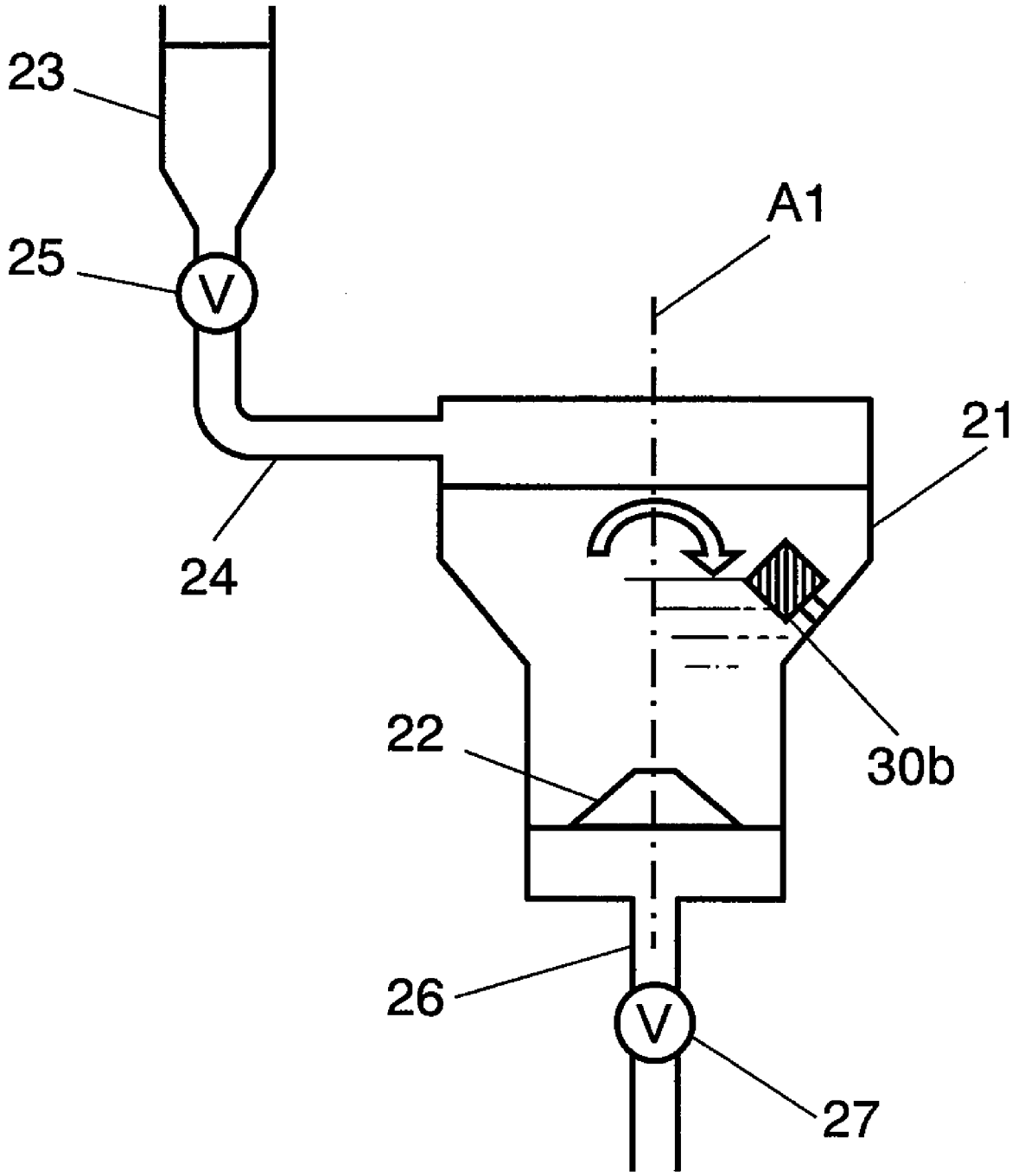
FIG. 3 is a schematic block diagram of a paper-making bath in a producing process of a loudspeaker diaphragm in accordance with another exemplary embodiment of the present invention.

A producing process of a loudspeaker diaphragm of another exemplary embodiment of the present invention is described with reference to FIG. 2 and FIG. 3. FIG. 2 and FIG. 3 are schematic diagrams of paper-making baths as essential parts of production units.

The production unit of the loudspeaker diaphragm of FIG. 2 has rotation plate 30*a* disposed outside paper-making bath 21. Rotation plate 30*a* fixed to attaching shaft 30*c* is lowered from the outside of paper-making bath 21 into water having pulp dispersed therein in paper-making bath 21. Rotation plate 30*a* placed in the water is rotated, thereby generating vortex stream in the water having pulp dispersed therein. Once vortex stream occurs, the water having pulp dispersed therein can keep a certain vortex stream due to the inertia for a certain time even after rotation plate 30*a* is raised out of the paper-making bath.

Subsequent steps are the same as in the first exemplary embodiment, and the description of the steps is omitted.

When the water having pulp dispersed therein is mechanically rotated using rotation plate 30*a*, vortex stream can be more certainly generated than when the vortex stream is generated with pressurized water or pressurized air. The water in paper-making bath 21 is simply required to rotate about rotation axis A1, and a method of rotating rotation plate 30*a* is not especially limited. For example, rotation plate 30*a* and attaching shaft 30*c* may be integrally rotated about center axis A1. In this case, rotation plate 30*a* and attaching shaft 30*c* are used as a rotating means.

Rotation plate 30*a* is disposed on rotation axis A1, and only rotation plate 30*a* may be rotated at this position. Rotation plate 30*a* is disposed at a position out of rotation axis A1, and only rotation plate 30*a* may be rotated at this position. In these cases, rotation plate 30*a* is used as a rotating means. Rotation plate 30*a* and attaching shaft 30*c* may be rotated as a rotating means on the axis. The shape and rotation speed of rotation plate 30*a* are not especially limited as long as water in paper-making bath 21 rotates about rotation axis A1.

FIG. 3 shows another example of the second exemplary embodiment. In the production unit of the loudspeaker diaphragm of FIG. 3, rotation plate 30*b* used as a rotating means is previously installed in paper-making bath 21. Rotating rotation plate 30*b* can generate vortex stream in the water having pulp dispersed therein in paper-making bath 21. At this time, when rotation plate 30*b* is stopped in paper-making bath 21, the generated vortex stream in the water having pulp dispersed therein also stops. Therefore, drainage channel opening/closing valve 27 is opened while rotation plate 30*b* is kept rotating, and the drainage from paper-making bath 21 through drainage pipe 26 is started.

In the production unit of the loudspeaker diaphragm of FIG. 3, rotation plate 30*b* in paper-making bath 21 is kept rotating during the drainage, so that the vortex stream generated in the water having pulp dispersed therein can be kept in a stabler state.

In the second exemplary embodiment, examples having one of rotation plates 30*a* and 30*b* have been described. Since installation of a plurality of rotation plates 30*a* or a plurality of rotation plates 30*b* allows stable vortex stream to be generated in a short time, a loudspeaker diaphragm with stabler physical properties can be produced efficiently.

Table 1 shows measured tensile strengths of diaphragms that are produced by a conventional producing process without vortex stream and diaphragms that are paper-made by a producing process employing a paper-making bath having vortex stream of the first exemplary embodiment.

TABLE 1

| | Conventional diaphragms | Loudspeaker diaphragms of first exemplary embodiment |
|---|---|---|
| 1 | 0.205 | 0.310 |
| 2 | 0.167 | 0.369 |
| 3 | 0.191 | 0.324 |

TABLE 1-continued

| | Conventional diaphragms | Loudspeaker diaphragms of first exemplary embodiment |
|---|---|---|
| 4 | 0.157 | 0.325 |
| Ave. | 0.1798 | 0.3321 |
| MAX. | 0.205 | 0.369 |
| MIN. | 0.157 | 0.310 |
| R | 0.048 | 0.060 |
| σ | 0.022 | 0.026 |

unit: kN

Table 2 shows measured face thicknesses of diaphragms that are produced by the conventional producing process and diaphragms that are produced by the producing process of the first exemplary embodiment.

TABLE 2

| | Conventional diaphragms | | Loudspeaker diaphragms of first exemplary embodiment | |
|---|---|---|---|---|
| | Inner peripheral side | Outer peripheral side | Inner peripheral side | Outer peripheral side |
| 1 | 0.25 | 0.25 | 0.28 | 0.30 |
| 2 | 0.29 | 0.27 | 0.29 | 0.31 |
| 3 | 0.30 | 0.29 | 0.30 | 0.29 |
| 4 | 0.26 | 0.30 | 0.29 | 0.30 |
| Ave. | 0.2750 | 0.2775 | 0.2900 | 0.3000 |
| MAX. | 0.300 | 0.300 | 0.300 | 0.310 |
| MIN. | 0.250 | 0.250 | 0.280 | 0.290 |
| R | 0.050 | 0.050 | 0.020 | 0.020 |
| σ | 0.024 | 0.022 | 0.008 | 0.008 |

unit: mm

As is clear from Table 1 and Table 2, the tensile strengths of the loudspeaker diaphragms of the first exemplary embodiment are higher than those of the conventional loudspeaker diaphragms. The face thicknesses of the loudspeaker diaphragms of the first exemplary embodiment are more uniform than those of the conventional loudspeaker diaphragms.

Table 1 and Table 2 show measurement results of four diaphragm samples 1, 2, 3 and 4, namely characteristic values of each diaphragm, the average values, maximum values, minimum values, differences R between the maximum values and minimum values, and deviations σ thereof.

Figure 4:
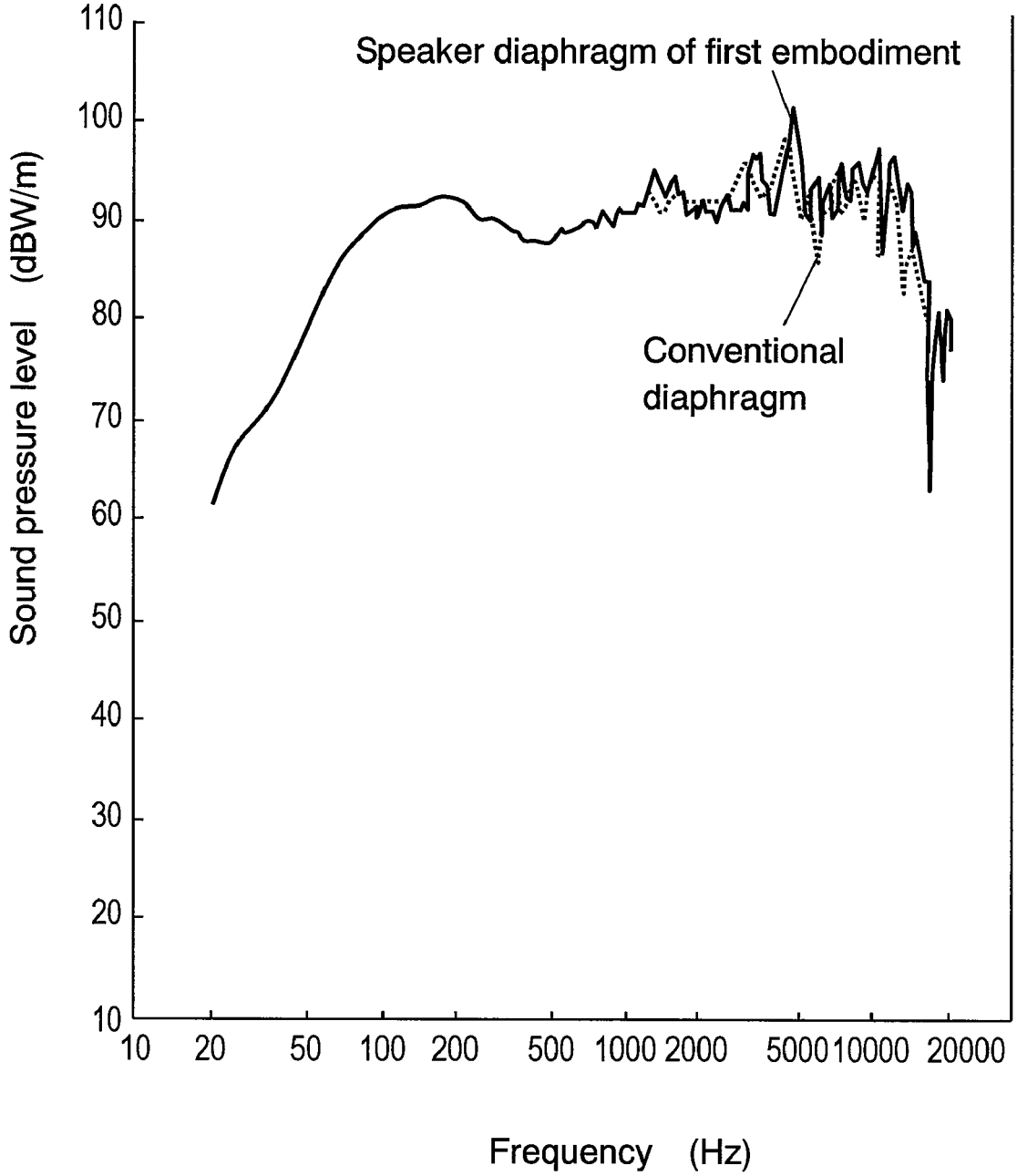
FIG. 4 is a frequency sound pressure characteristic diagram of a loudspeaker employing a loudspeaker diaphragm produced by the producing process of the loudspeaker diaphragm of the present invention

FIG. 4 shows measured frequency sound pressure characteristics of a loudspeaker that employs a loudspeaker diaphragm produced by the conventional producing process and a loudspeaker that employs a loudspeaker diaphragm produced by the producing process of the first exemplary embodiment. The configuration except the loudspeaker diaphragm of the loudspeaker of the first exemplary embodiment is the same as that of the conventional loudspeaker.

According to FIG. 4, the loudspeaker employing the loudspeaker diaphragm of the first exemplary embodiment of the present invention has an improved frequency-sound pressure characteristic in intermediate and high frequency region compared with the conventional loudspeaker that employs a loudspeaker diaphragm produced by the conventional producing process.

INDUSTRIAL APPLICABILITY

A loudspeaker diaphragm of the present invention allows stable production of products where the pulp fiber orientation is uniform and the face thickness and face rigidity are uniform on the same circumference in the same diaphragm. This loudspeaker diaphragm is useful for a digital acoustic apparatus.

The invention claimed is:

1. A process for producing a loudspeaker diaphragm comprising:

stirring pulp dispersed in water in a paper-making bath to form a vortex stream in the water in the paper-making bath; and depositing pulp on a paper-making mold while continuing to stir the pulp dispersed in the water in the paper-making bath to continue the vortex stream in the water.

2. The process for producing a loudspeaker diaphragm of claim 1, wherein the vortex stream is formed by spraying pressurized water to the water dispersing the pulp in the paper-making bath.

3. The process for producing a loudspeaker diaphragm of claim 2, wherein the pressurized water is sprayed from one or more nozzles into the paper-making bath.

4. The process for producing a loudspeaker diaphragm of claim 1, wherein the vortex stream is formed by spraying pressurized air to the water dispersing the pulp.

5. The process for producing a loudspeaker diaphragm of claim 4, wherein the pressurized air is sprayed from one or more nozzles into the paper-making bath.

6. The process for producing a loudspeaker diaphragm of claim 1, wherein the vortex stream is formed by rotating one or more rotating means in the paper-making bath.

7. The process for producing a loudspeaker diaphragm of claim 1, wherein a center axis of the vortex stream matches with a center axis of the paper-making mold.

8. The process for producing a loudspeaker diaphragm of claim 1, wherein the step of depositing the pulp is a step of discharging the water in the paper-making bath in the presence of the vortex stream of the water dispersing the pulp.

9. A loudspeaker diaphragm comprising pulp fiber oriented axisymmetrically with respect to an axis passing the center of gravity of a loudspeaker, the loudspeaker diaphragm produced using a process comprising:

stirring dispersed in water in a paper-making bath to form a vortex stream in the water in the paper-making bath; and depositing pulp on a paper-making mold while continuing to stir the pulp dispersed in the water in the paper-making bath to continue the vortex stream in the water.

10. A loudspeaker comprising:

a frame coupled to a magnetic circuit;

a loudspeaker diaphragm comprising pulp fiber oriented axisymmetrically with respect to an axis passing a center of gravity of the loudspeaker, the loudspeaker diaphragm coupled to an outer periphery of the frame and produced using a process for producing a loudspeaker diaphragm comprising:

stirring pulp dispersed in water in a paper-making bath to form a vortex stream in the water in the paper-making bath; and depositing pulp on a paper-making mold while continuing to stir the pulp dispersed in the water in the paper-making bath to continue the vortex stream in the water; and a voice coil coupled to the loudspeaker diaphragm, one end of the voice coil being inserted into a magnetic gap of the magnetic circuit.

* * * * *